US011149389B2

(12) United States Patent
Woell et al.

(10) Patent No.: US 11,149,389 B2
(45) Date of Patent: Oct. 19, 2021

(54) GROUND MILLING MACHINE AND METHOD TO OPERATE A GROUND MILLING MACHINE

(71) Applicant: BOMAG GMBH, Boppard (DE)

(72) Inventors: Horst Woell, Boppard (DE); Thorsten Joerig, Boppard (DE)

(73) Assignee: BOMAG GMBH, Boppard (DE)

( * ) Notice: Subject to any disclaimer, the term of this patent is extended or adjusted under 35 U.S.C. 154(b) by 75 days.

(21) Appl. No.: 16/547,961

(22) Filed: Aug. 22, 2019

(65) Prior Publication Data

US 2020/0063386 A1 Feb. 27, 2020

(30) Foreign Application Priority Data

Aug. 23, 2018 (DE) ..... 10 2018 006 688.7

(51) Int. Cl.
*E01C 23/088* (2006.01)
*E01C 21/00* (2006.01)
(Continued)

(52) U.S. Cl.
CPC ..... *E01C 23/088* (2013.01); *E01C 21/00* (2013.01); *E01C 23/065* (2013.01); *E01C 23/127* (2013.01)

(58) Field of Classification Search
CPC ..... E01C 23/08; E01C 23/0946; E01C 21/00; E01C 23/065; E01C 23/088;
(Continued)

(56) References Cited

U.S. PATENT DOCUMENTS 4,055,160 A * 10/1977 Wilson ..... B27G 19/02 125/13.03
5,893,677 A * 4/1999 Haehn ..... E01C 23/065 404/90

(Continued)

FOREIGN PATENT DOCUMENTS

DE 3921875 1/1991
DE 102013020679 6/2014

(Continued)

OTHER PUBLICATIONS

Search Report from corresponding German Appln. No. 10 2018 006 688.7, dated Jul. 31, 2019.

*Primary Examiner* — Janine M Kreck
*Assistant Examiner* — Michael A Goodwin
(74) *Attorney, Agent, or Firm* — Grossman, Tucker, Perreault & Pfleger, PLLC

(57) ABSTRACT

A ground milling machine, in particular a soil stabilizer or a recycler, comprising a machine frame carried by front and rear traveling devices, a drive engine arranged on the machine frame, a ground milling device with a milling rotor supported for rotation about a horizontal rotation axis extending transversely to the working direction of the ground milling machine, said milling rotor having a plurality of ground processing tools, and with a milling rotor housing having an interior space which is open in the downward direction towards the underlying ground and in which the milling rotor is arranged, said milling rotor being height-adjustable via a milling depth adjusting device having a drive, and said milling rotor housing being connected to the machine frame via a housing support device. The invention further relates to a method for operating a ground milling machine. According to an essential aspect of the invention, provision is made for a lifting movement of the front edge
(Continued)

of the milling rotor housing relative to the machine frame depending on the milling depth.

19 Claims, 5 Drawing Sheets

(51) Int. Cl.
*E01C 23/06* (2006.01)
*E01C 23/12* (2006.01)

(58) Field of Classification Search
CPC ..... E01C 23/0933; E01C 23/0993; E01C 23/127; B28D 1/042
See application file for complete search history.

(56) References Cited

U.S. PATENT DOCUMENTS

| | | | | |
|---|---|---|---|---|
| 2005/0123350 | A1* | 6/2005 | Ley | E01C 23/088 404/94 |
| 2013/0341996 | A1* | 12/2013 | Franzmann | E01C 23/088 299/1.5 |
| 2016/0024728 | A1 | 1/2016 | Menzenbach et al. | |
| 2017/0138004 | A1* | 5/2017 | Berning | E01C 23/088 |
| 2018/0135257 | A1 | 5/2018 | Schlenker et al. | |

FOREIGN PATENT DOCUMENTS

| | | |
|---|---|---|
| DE | 102014214436 | 1/2016 |
| DE | 102016001688 | 3/2017 |
| DE | 102017126634 | 5/2018 |

* cited by examiner

GROUND MILLING MACHINE AND METHOD TO OPERATE A GROUND MILLING MACHINE

FIELD

The invention relates to a ground milling machine and a method for operating a ground milling machine.

BACKGROUND

Generic ground milling machines are known in the prior art, for example from DE102013020679A1. Such ground milling machines are used for milling off ground surfaces (road cold milling machines) and/or for milling and admixing aggregates for stabilizing the subsoil (soil stabilizers) and/or in the recycling and upgrading of existing road surfaces (recyclers).

Essential elements of such generic and typically self-propelled ground milling machines, in particular soil stabilizers or recyclers, include a machine frame carried by front and rear traveling devices, which may be wheels and/or crawler tracks, said machine frame having arranged thereon a drive engine, typically a diesel engine, which is used to produce the drive power required for the traveling and milling operation. The ground milling machine is usually controlled from an operator platform arranged on the machine frame, for example, in the form of a driver's cab. An essential element of the ground milling machine is a ground milling device having a milling rotor and a milling rotor housing. The milling rotor comprises, for example, a support tube having an outer circumferential surface on which a plurality of milling tools, in particular milling chisels, is arranged in a radially protruding manner. The milling rotor is supported inside the milling rotor housing for rotation about a horizontal rotation axis extending transversely to the working direction of the ground milling machine. The working direction here designates the direction in which the ground milling machine travels during working or milling operation, i.e. usually the forward direction of the ground milling machine. The milling rotor housing encases the milling rotor towards the outside environment to enable controlled material guidance of the milled material in the region of the milling rotor. The milling rotor housing thus comprises an interior space which is open in the vertical downward direction, i.e. towards the underlying ground, and in which the milling rotor is arranged. The milling rotor is further height-adjustable relative to the underlying ground via a milling depth adjusting device having a drive, so that the extent or depth to which the milling rotor engages the underlying ground during working operation can be varied with the aid of said milling depth adjusting device. For this, the milling rotor may, for example, be articulated to the machine frame in a height-adjustable manner via at least one swivel arm adjustable about a milling rotor swivel arm axis as part of the milling depth adjusting device for adjusting the milling depth of the milling rotor, as described, for example, in DE102013020679A1. It is also possible to adjust the milling depth via an adjustment of vertically adjustable lifting columns which connect the traveling devices to the machine frame, in which case the lifting columns form an essential part of the milling depth adjusting device. The milling rotor housing is connected to the machine frame via a housing support device. The housing support device thus serves to at least partially support the milling rotor housing at the machine frame. The housing support device may further be detachable, for example, to enable switching between different initial positions of the milling rotor housing or a replacement of the entire ground milling device, for example, to vary the respective milling width.

During operation of such ground milling machines, in particular at relatively large milling depths, the milling performance is oftentimes reduced by milled material gathering inside the interior space of the milling rotor housing. The accumulating milled material then forms a resistance against the rotational movement of the milling rotor. This may slow down the work process considerably.

SUMMARY

In view of the aforesaid, the object of the invention is to provide a solution for a generic ground milling machine and a method for operating a ground milling machine which enable an improved operation at comparably large milling depths.

According to the invention, the object is achieved by providing a housing adjusting device which is configured such that it changes the position of the milling rotor housing relative to the machine frame depending on the milling depth of the milling rotor such that the milling rotor housing is lifted with its front edge with increasing milling depth, and vice versa. The basic idea of the invention thus consists in enlarging the interior space inside the milling rotor housing compared to conventional ground milling machines depending on the milling depth and at least for comparably large milling depths through a movement of the milling rotor housing in the manner described above. The lifting, and thus upward swiveling, of the front edge of the rotor housing creates more space for the milled material inside the milling rotor housing, which reduces the resistance against the rotational movement of the milling rotor created by the milled material, so that a high milling performance is possible even at large milling depths. The invention is further based on the finding that a closure of the milling rotor housing in its front region towards the underlying ground is not necessarily required at large milling depths since, for example, an ejection of appreciable amounts of milled material is prevented sufficiently reliably by the milled material accumulating in this region underneath the milling rotor housing. An essential aspect of the invention is thus that the milling rotor housing is lifted in the working direction at the front relatively to the machine frame with the aid of the housing adjusting device. The milling rotor housing is thus partially tilted upwards relatively to the machine frame about a horizontal axis extending transversely to the working direction, which enlarges the free space underneath the milling rotor housing towards the milling rotor and the underlying ground, in particular in the region in front of the milling rotor in the working direction. The housing adjusting device here designates those elements via which, or via the cooperation of which, this adjusting movement of the milling rotor housing relative to the machine frame is ultimately effected in a coordinated manner According to the invention, an essential characteristic of the housing adjusting device is thus that it is designed such that, depending on the current milling depth of the milling rotor and at least in a subregion of the maximum possible milling depth range, it adjusts the relative position of the milling depth housing such that its front region is lifted relative to the machine frame when the milling depth adjusting device lowers the milling rotor towards a comparably large milling depth, i.e. when the milling depth increases. The starting point here is a so-called zero position in which the bottom edge of the milling rotor rests on the non-milled underlying ground and/or in which the milling rotor housing comes into contact with the underlying ground during a lowering of the ground milling device starting from a transport position in which it is lifted above the underlying ground. In this situation, the milling depth is thus zero. From this point, the milling depth can now be increased up to a maximum milling depth by a further lowering of the milling rotor into the underlying ground. This is the region of the movement range of the milling rotor for which the lifting movement of the front edge of the milling rotor housing and the concomitant tilting movement described above are provided. According to the invention, the front edge of the milling rotor housing is then lifted with increasing milling depth and is lowered back to its initial position in the reverse direction with decreasing milling depth.

With respect to the total movement of the milling rotor housing, it is possible that the movement achieved via the housing adjusting device changes not only the position, in particular the position in the vertical direction, of the front edge relative to the machine frame but, at least to a small extent, also the position of the rear edge of the milling rotor housing. However, according to the invention, the lifting movement of the milling rotor housing relative to the machine frame in vertical direction (if positioned in the ground horizontally) is larger in the region of its front edge than in the region of its rear edge. It is thus essential here that the milling rotor housing is not lifted only in vertical direction in its entirety relative to the machine frame but in any case also performs a tilting movement such that the front edge of the milling rotor housing is lifted farther than the rear edge of the milling rotor housing when the milling depth increases. Preferably, however, the housing adjusting device is configured such that, for lifting the front edge, the housing adjusting device causes the milling rotor housing to rotate or tilt about a virtual axis, in particular such that the vertical distance of a rear edge of the milling rotor housing from the machine frame remains essentially constant. Through this, for example, the stripping region, which is normally formed by the rear bottom edge of the milling rotor housing, remains essentially unchanged relative to the machine frame during the lifting movement of the front edge, i.e. the relative adjustment of the milling rotor housing in relation to the machine frame, so that the ground milling machine achieves a processing pattern of the underlying ground which remains unchanged by, i.e. independent of, the respective position assumed by the milling rotor housing relative to the machine frame.

With respect to the specific design of the housing adjusting device, a plurality of alternative embodiments may be used to achieve the movement of the milling rotor housing relative to the machine frame according to the invention. The housing adjusting device may, for example, have a sensor device for ascertaining the milling depth, a control unit, and an adjusting motor for adjusting the relative position of the milling rotor housing, said control unit controlling the adjusting motor depending on the currently ascertained milling depth. In this embodiment, the current milling depth is thus ascertained actively with the aid of the sensor device, to which end a suitable sensor, for example, ascertains a corresponding adjustment parameter in the milling depth adjusting device, for example inside one or more lifting columns and/or at a rotor swivel arm, and forwards it to the control unit. The latter then controls the housing adjusting device depending on the ascertained sensor values in such a manner that the milling rotor housing is lifted with its front edge with increasing milling depth, and vice versa. This modified embodiment of the invention thus particularly preferably comprises a housing adjusting device that has its own drive, which is in particular provided exclusively for the adjusting movement of the milling rotor housing. An advantage of this solution is that the operator can select between a mode in which the position of the milling rotor housing relative to the machine frame changes in the above described manner depending on the milling depth of the milling rotor and a mode in which the milling rotor housing maintains its relative position even at large milling depths.

Additionally or alternatively, the housing adjusting device and the milling depth adjusting device are preferably coupled, in particular forcibly coupled, to one another. In the present context, a forced coupling means that the position of the milling rotor housing relative to the machine frame and the milling depth of the milling rotor influence or determine each other through the presence of a suitable coupling device. The milling depth adjusting device and the housing adjusting device are ideally both driven jointly via the drive of the milling depth adjusting device. In this embodiment, a single shared drive is thus provided the drive movement of which drives both the adjusting movement of the milling rotor and the adjusting movement of the milling rotor housing relative to the machine frame. This shared drive is preferably an actuator of the hydraulic motor or hydraulic cylinder type.

In the practical implementation of the invention, it has turned out to be preferable that the housing adjusting device has an adjusting mechanism, in particular a cam mechanism. An adjusting mechanism is characterized in that it has multiple mechanism elements which interact mechanically, for example articulated levers etc. In this regard, use is ideally made of a linkage or cam mechanism. Cam mechanisms are characterized in that a relative movement is performed by tracing a control cam. The cam mechanism is in this case ideally configured as a two-dimensional cam mechanism, i.e. a cam mechanism having a control cam that extends in one plane. Such a mechanism is particularly space saving.

The adjusting mechanism of the housing adjusting device thus preferably comprises a control cam. The control cam is ideally a control cam which is integrated into a sidewall of the milling rotor housing. A sidewall of the milling rotor housing designates a limiting wall of the milling rotor housing which intersects the rotation axis of the milling rotor, or extends adjacent to one of the two face sides of the milling rotor. The integration of the control cam into the sidewall of the milling rotor housing achieves a particularly compact arrangement of the housing adjusting device since the respective sidewall then fulfills a dual function. The control cam is in this case particularly preferably traced by at least one rotor swivel arm or an element that is moved together with the rotor swivel arm. In this embodiment, the milling rotor is thus supported at the machine frame of the ground milling machine via a rotor swivel arm and in particular via two rotor swivel arms arranged opposite each other at the face sides of the milling rotor. The at least one rotor swivel arm can swivel about a swivel arm axis. When the rotor swivel arm is lowered, the milling rotor immerses in the underlying ground, and vice versa. If a pair of rotor swivel arms is provided, both face-sided sidewalls of the milling rotor housing preferably have a respective control cam, in particular mirror-symmetrical control cams.

Additionally or alternatively, the adjusting mechanism of the housing adjusting device preferably further comprises at least one swivel thrust joint in or at a swivel lever which connects the machine frame to the milling rotor housing. The swivel thrust joint is in this case arranged such that it can exert a thrust force on the milling rotor housing while simultaneously swiveling about at least one joint axis. In an optimal configuration, the swivel thrust joint additionally has a slot guide to avoid triggering an adjustment of the milling rotor housing relative to the machine frame in certain milling depth ranges, for example small milling depths.

An essential aspect of the invention is that the free space for milled material inside and underneath the milling rotor housing is enlarged by lifting the front edge of the milling rotor housing at comparably large milling depths. According to the invention, this effect can be increased further if the housing adjusting device is configured such that it controls not only the lifting movement of the milling rotor housing but also a horizontal displacement of the milling rotor housing relative to the machine frame such that the milling rotor housing is displaced in the working direction towards the front relative to the machine frame and relative to the milling rotor with increasing milling depth, and vice versa. According to this modified embodiment of the invention, the milling rotor housing thus not only performs a tilting movement relative to the machine frame according to the above description but, simultaneously or at least during certain phases alternatively to this, also a linear displacing movement relative to the machine frame which is oriented horizontally towards the front in the working direction. This thus also increases the free space inside the milling rotor housing in the working direction in front of the milling rotor.

According to the invention, the housing adjusting device may preferably be configured such that the horizontal displacement and the lifting movement of the milling rotor housing occur at least partially concurrently across the range between a position in which the milling rotor rests on the non-milled underlying ground and the maximally lowered milling rotor, i.e. the maximum milling depth. The housing adjusting device may now be configured such that the horizontal displacement and the lifting movement of the milling rotor housing always occur together, i.e. take place simultaneously. In a preferred configuration, however, the horizontal displacement and the lifting movement of the milling rotor housing occur only partially concurrently. Ideally, the housing adjusting device is configured such that, during a lowering of the milling rotor into the underlying ground starting from a zero position of the milling rotor, initially only a horizontal displacement of the milling rotor housing is performed in the manner described above. The additional or alternative lifting of the front edge of the milling rotor housing relative to the machine frame is performed, in the manner described above, only subsequently, i.e. upon reaching or exceeding a threshold milling depth.

A further aspect of the invention relates to a method for operating a ground milling machine, in particular a ground milling machine according to the invention. Such a ground milling machine comprises in particular a machine frame carried by front and rear traveling devices, a ground milling device with a milling rotor supported for rotation about a horizontal rotation axis extending transversely to the working direction of the ground milling machine, said milling rotor having a plurality of ground processing tools, and with a milling rotor housing having an interior space which is open in the downward direction towards the underlying ground and in which the milling rotor is arranged, said milling rotor being articulated to the machine frame in a height-adjustable manner via at least one milling depth adjusting device, said milling rotor housing being connected to the machine frame via a housing support device. As regards further features of a ground milling machine preferred for use in carrying out the method according to the invention, reference is made to the above description concerning the ground milling machine according to the invention.

What is essential for the method according to the invention now is that during operation of the ground milling machine, more specifically during milling operation, the position of the milling rotor housing relative to the machine frame is adjusted with a housing adjusting device depending on the milling depth of the milling rotor such that a front edge of the milling rotor housing is lifted relative to the machine frame with increasing milling depth. There is thus a defined change in the relative position of the milling rotor housing in relation to the machine frame carrying the milling rotor housing, the adjustment being subject to the current milling depth of the milling rotor. It is thus possible to selectively optimize the positioning of the milling rotor housing at the machine frame for comparably large milling depths at which a particularly large amount of milled material gathers in the working direction in front of the milling rotor such that more space is now available for this milled material and thus, all in all, an improved handling of the milled material is achieved at large milling depths. What is essential here is that the milling rotor housing thus performs a tilting movement causing it to be moved vertically upwards with its front edge. Generally, provision may be made for the rear edge of the milling rotor housing to also change its relative position, although preferably only to a very limited extent. However, to achieve the tilting of the milling rotor housing, the front edge of the milling rotor housing will always be lifted vertically upwards relative to the machine frame much farther than the rear edge.

The lifting of the milling rotor housing does not become relevant during the lowering of the milling rotor onto the underlying ground from a position in which it was lifted far above the underlying ground, as is the case, for example, during a switch from a transportation operation to commencement of the milling operation. When the milling rotor is in a position lowered onto the underlying ground, it is in the so-called zero position, i.e. the milling depth is zero. It is now possible to design the method according to the invention such that an adjusting movement of the milling rotor housing is performed in the manner described above immediately with the commencement of the lowering of the milling rotor into the underlying ground starting from the zero position, i.e. with the commencement of an increase in the milling depth starting from a milling depth of zero. A tilting of the milling rotor housing with a lifting of the front edge would thus already occur at comparably small milling depths. In a preferred design, however, starting from an initial position in which the milling rotor rests on the non-milled underlying ground, i.e. in which its circumferential bottom edge is supported parallel to and closely above the underlying ground, the lifting of the front edge of the milling rotor housing occurs only upon exceedance of a threshold milling depth. On the one hand, this ensures adequate closure of the interior space of the milling rotor housing at small milling depths, i.e. in a range of small milling depths in which only a small amount of milled material gathers in the working direction in front of the milling rotor inside the milling rotor housing. On the other hand, the enlargement of the free space available in the working direction in front of the milling rotor for accommodating the milled material then occurs starting at milling depths at which milled material gathering in the working direction in front of the milling rotor starts to have a negative impact on the milling performance of the ground milling machine. The adjustment of the relative position of the milling rotor housing thus preferably occurs only when a defined milling depth, i.e. the threshold milling depth, has been exceeded through adjustment of the milling rotor using the milling depth adjusting device.

The specific adjusting movement of the milling rotor housing may also vary. In practical use, however, the lifting of the front edge of the milling rotor housing is preferably performed such that a rear edge of the milling rotor housing essentially maintains its vertical position relative to the machine frame. At least in the vertical direction, the milling rotor housing thus preferably terminates at a constant level relative to the machine frame at different milling depths.

According to another possible variation, the extent of the lifting movement at increasing milling depth is, for example, proportional or exponential to the change in milling depth.

For further optimization, a displacing of the milling rotor housing in the working direction towards the front may be performed in addition to the lifting of the front edge of the milling rotor housing with increasing milling depth. This is based on the idea that an enlargement of the free space inside the milling rotor housing in the working direction in front of the milling rotor is also possible through a displacement of the milling rotor housing in the working direction towards the front relative to the machine frame and relative to the milling rotor, although to a relatively limited extent. According to this embodiment, the milling rotor housing is thus adjustable relative to the machine frame with a total of two degrees of freedom, i.e., on the one hand, in linear direction along the working direction, and, on the other hand, about a swivel axis, said swivel axis extending in particular horizontally and transversely to the working direction, when the front edge of the milling rotor housing is lifted relative to the machine frame with increasing milling depth.

It is possible that the displacing of the milling rotor housing and the lifting of the front edge of the milling rotor housing occur separately in terms of sequence of motions, for example a displacing of the milling rotor housing is to occur first and is only subsequently followed by a lifting of the front edge of the milling rotor housing. Alternatively, it is also possible that a lifting of the front edge of the milling rotor housing is performed with every displacement of the milling rotor housing. However, the displacing of the milling rotor housing in the working direction towards the front is preferably performed at least, and in particular only, partially concurrently with the lifting of the front edge of the milling rotor housing, in particular depending on the exceedance of a threshold milling depth. This embodiment is characterized in that the milling rotor housing is initially moved in the working direction towards the front with increasing milling depth. A lifting of the front edge of the milling rotor housing, and thus a tilting of the milling rotor housing, occurs in addition to the displacing movement of the milling rotor housing only after the milling rotor has exceeded the threshold milling depth.

According to a preferred modification of the method according to the invention, the lifting of the front edge of the milling rotor housing is controlled by tracing a control cam, in particular a control cam integrated into the milling rotor housing, by a rotor swivel arm or an element that is movable together with said rotor swivel arm. The adjusting of the milling depth of the milling rotor thus occurs through the adjustment of a rotor swivel arm, preferably a pair of rotor swivel arms, that can swivel about a swivel axis. The milling rotor is thus preferably supported for rotation about its rotation axis between two rotor swivel arms. With the aid of the control cam described above, the swivel movement of the rotor swivel arm can now be utilized to control the relative position of the milling rotor housing depending on the swivel position of the rotor swivel arm and thus the current milling depth.

Additionally or alternatively, according to the method according to the invention, the adjusting of the position of the milling rotor housing relative to the machine frame may involve running along a slot guide in a swivel thrust lever which connects the machine frame to the milling rotor housing.

The lifting and/or displacing of the milling rotor housing is preferably forcibly coupled, in particular mechanically, to an adjusting of the milling depth of the milling rotor. In this manner, it is ensured that the position of the milling rotor housing relative to the machine frame is always changed in the manner described above at large milling depths.

Although is generally possible to drive the lifting and/or displacing of the milling rotor housing and the adjusting of the milling depth with separate drives, it is advantageous if a shared drive is used for this, i.e. if the adjusting movement of the milling rotor housing relative to the machine frame and the adjustment of the milling depth are driven via a shared drive, in particular an actuator of the hydraulic motor type or at least a linearly displaceable hydraulic cylinder.

BRIEF DESCRIPTION OF THE DRAWINGS

The invention will be explained in more detail below by reference to the embodiment examples indicated in the figures. In the schematic figures.

DETAILED DESCRIPTION

Figure 1:
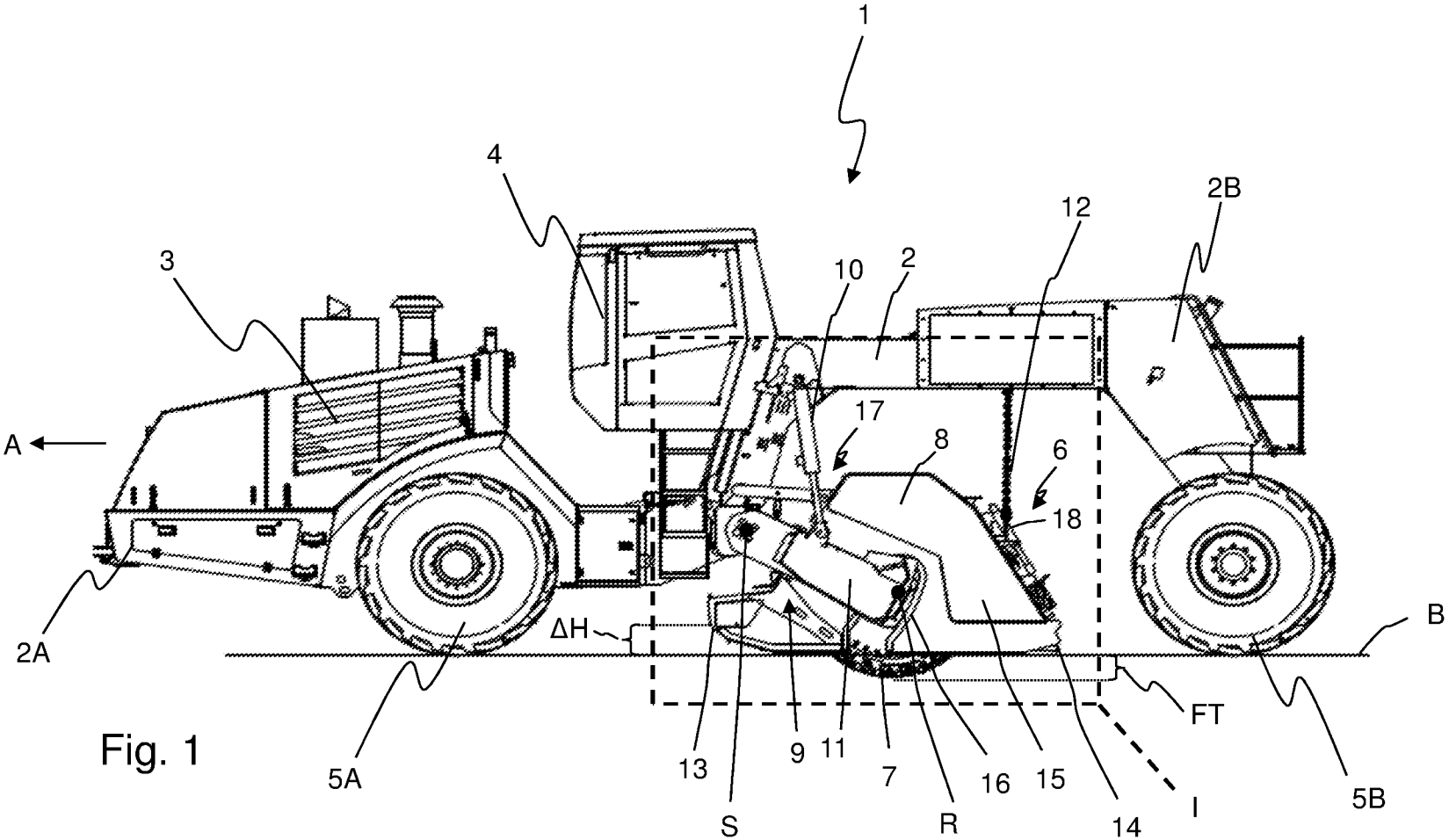
FIG. 1 is a side view of a ground milling machine in milling operation at small milling depth with non-lifted milling rotor housing, i.e. with the milling rotor housing in the zero position.

Like components are designated by like reference numerals in the figures, although not every recurring component is necessarily designated separately throughout the figures.

FIG. 1 shows a ground milling machine 1, in this case of the soil stabilizer and/or recycler type, in milling operation at small milling depth FT. Essential elements of the ground milling machine 1 include a machine frame 2, which in the present case is an articulated machine frame having a front frame 2A and a rear frame 2B. A continuous machine frame 2 without articulation may also be used. The ground milling machine 1 further comprises a drive engine 3, a driver's cab 4 as well as front traveling devices 5A and rear traveling devices 5B, in the present case wheels, although crawler tracks may be used as well. The drive engine 3 produces the drive power required for traveling and milling operation. The ground milling machine 1 is operated from the operator platform 4. Generally, and regardless of the present embodiment example, the ground milling machine 1 may be self-propelled.

Another essential element of the ground milling machine 1 is a ground milling device 6, which is arranged on the machine frame 2 between the front traveling devices 5A and the rear traveling devices 5B. Essential elements of the ground milling device 6 include a milling rotor 7 and a milling rotor housing 8. The milling rotor 7 is arranged inside the milling rotor housing 8, which is open towards the underlying ground B, and may, for example, have a support tube not shown in further detail having an outer circumferential surface on which a plurality of milling tools is arranged. The milling rotor housing 8 shields the milling rotor 7 from the outside environment towards the top, the face sides and the front and rear, enabling a controlled guidance of milled material inside the milling rotor housing 8. The milling rotor 7 is arranged inside the milling rotor housing for rotation about a horizontal rotation axis R extending transversely to the working direction A and protrudes in vertical downward direction beyond the bottom edge of the milling rotor housing 8 by the milling depth FT during milling operation. The milling rotor 7 is height-adjustable to enable the milling depth FT to be varied and the milling rotor 7 to be lifted out of the underlying ground, for example for a transportation operation. The height adjustment of the milling rotor 7 is performed via a milling depth adjusting device 9 having as its essential elements an adjusting drive 10 as well as a rotor swivel arm 11. The rotor swivel arms 11 are provided as a pair and are arranged at both face sides of the milling drum 7 (only the left rotor swivel arm 11 being visible in the side view of FIG. 1). The rotor swivel arm 11 is articulated to the machine frame 2 about a horizontal swivel axis S extending transversely to the working direction A. The swivel movement of the rotor swivel arm 11 is driven via the adjusting drive 10, which in the present embodiment example is a hydraulic cylinder arranged between the machine frame 2 and the rotor swivel arm 11. When the hydraulic cylinder is retracted, the rotor swivel arms 11 swivel upwards about the swivel axis S while carrying the milling rotor 7 along, and vice versa. This is illustrated, for example, by a comparison of FIG. 1, in which a comparably small milling depth FT is shown, with the side view of FIG. 2, in which the ground milling machine 1 of FIG. 1 is shown at a comparably large milling depth FT.

The milling rotor housing 8 is, on the one hand, connected to the machine frame 2 of the ground milling machine 1 via a housing support device 12, which in the present embodiment example is a connection chain suspended vertically from the machine frame 2 and articulated to the rear region of the milling rotor housing 8. The milling rotor housing 8 further comprises a front edge 13, which in the present case designates the region of the milling rotor housing 8 located in the working direction A at the front, i.e. the front bottom edge of the milling rotor housing 8 in the working direction A, and a rear edge 14, which in the present case designates the region of the milling rotor housing 8 located in the working direction A at the rear (i.e. the rear bottom edge in the working direction A). The milling rotor housing 8 further has a respective sidewall 15 at both face sides of the milling rotor 7. Provided in said sidewall 15 is an elongated recess 16 through which a support connection extends from the inner side of the respective rotor swivel arm 11 to the milling rotor 7 arranged inside the milling rotor housing 8.

Figure 2:
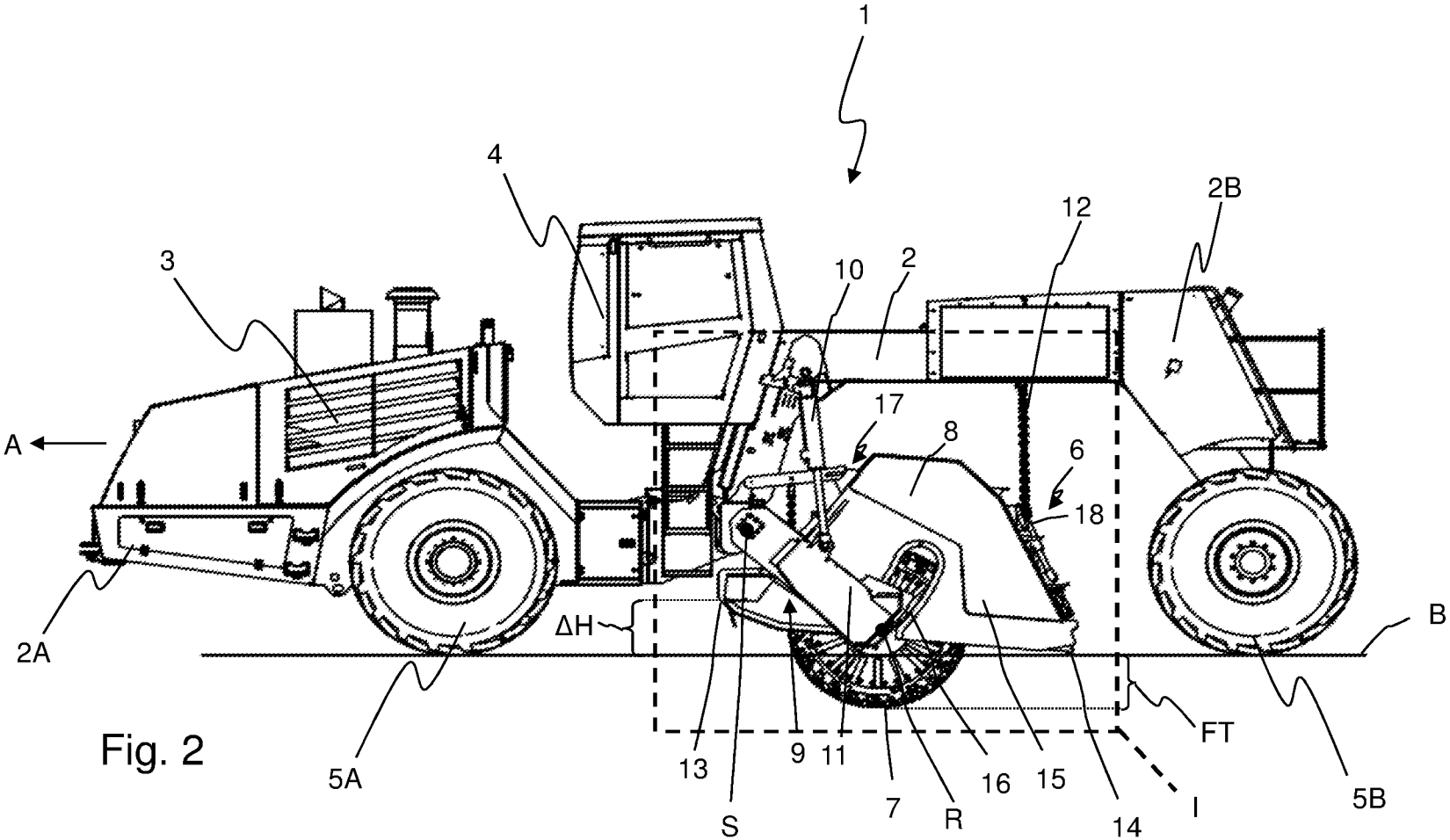
FIG. 2 is a side view of a ground milling machine in milling operation at large milling depth with lifted milling rotor housing.

An essential feature of the ground milling machine depicted in FIGS. 1 and 2 now consists in the fact that a housing adjusting device 17 is provided which effects an adjustment of the position of the milling rotor housing 8 relative to the machine frame 2 such that the milling rotor housing 8 is lifted in the region of its front edge 13 relative to the rear edge 14 of the milling rotor housing 8 with increasing milling depth FT. This is illustrated by a comparison of FIG. 1 with FIG. 2. In FIG. 1, the distance of the front edge 13 of the milling rotor housing 8 is designated with ΔH. Starting from FIG. 1, the milling depth FT is enlarged towards FIG. 2 by a downward swiveling of the rotor swivel arms 11. The housing adjusting device 17 here causes an enlargement of the distance ΔH of the front edge 13 of the milling rotor housing 8 simultaneously with the increase in milling depth FT by adjusting the position of the milling rotor housing 8 relative to the machine frame 2, more specifically by lifting the front edge 13 relative to the machine frame. The rear edge 14, on the other hand, essentially maintains its position, i.e. its position relative to the machine frame 2, at both milling depths. The milling rotor housing 8 thus essentially tilts or rotates about the connection joint 18 between the connection chain of the housing support device 12 and the milling rotor housing 8.

An essential advantage of the arrangement shown in FIGS. 1 and 2 is that, as will be described in more detail below, only one single shared drive, more specifically the adjusting drive 10, is required for both the height adjustment of the milling rotor 7 as well as the movement of the milling rotor housing 8 in the manner described above. The milling depth adjusting device 9 and the housing adjusting device 17 are thus forcibly coupled to one another, so that an adjustment of the milling depth with the aid of the milling depth adjusting device 9 at the same time causes a change in the position of the milling rotor housing 8 relative to the machine frame 2 with the aid of the housing adjusting device 17.

Figure 4:
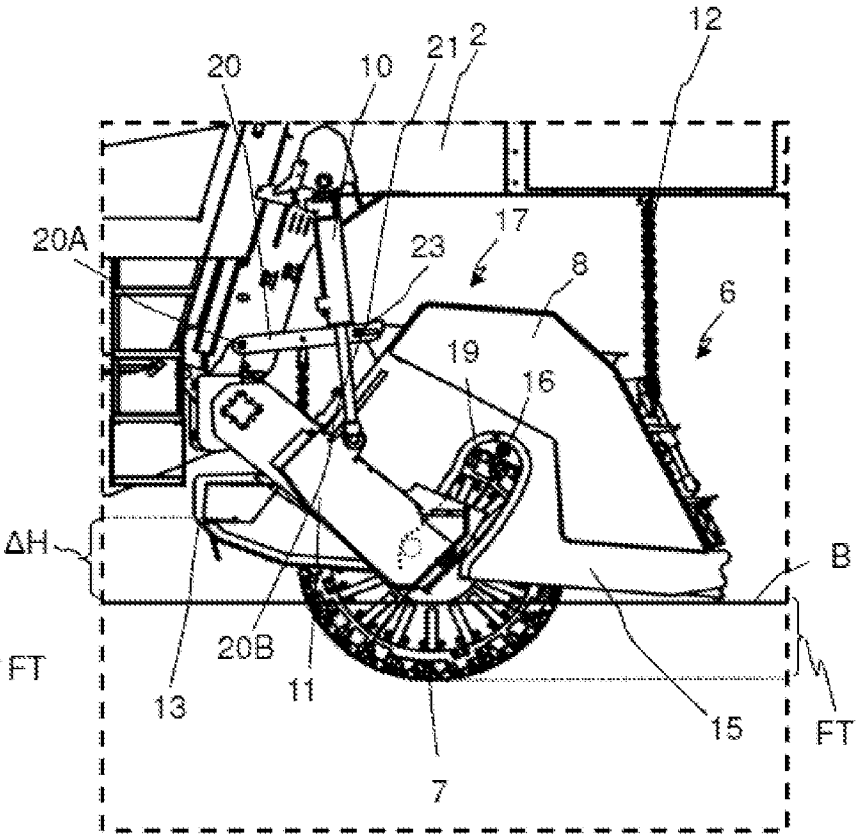
FIG. 4 is an enlarged cut-out view of the region I of FIG. 2.
Figure 3:
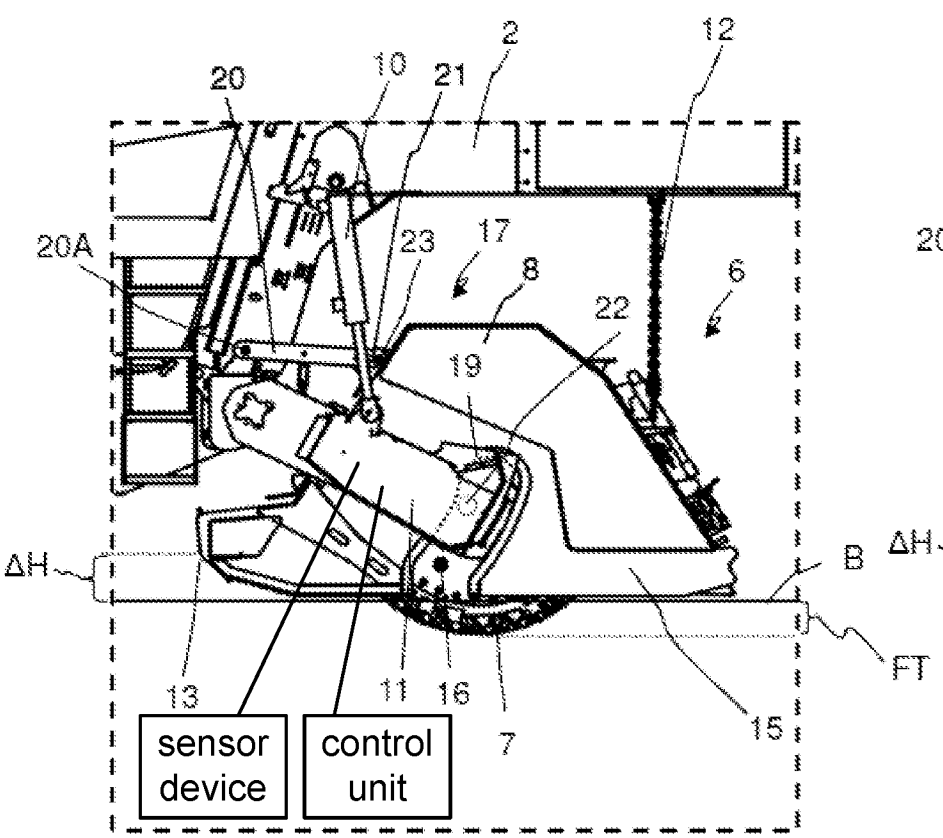
FIG. 3 is an enlarged cut-out view of the region I of FIG. 1.

For further illustration, FIGS. 3 and 4 now show enlarged cut-out views of the region I of FIG. 1 (in FIG. 3) and of FIG. 2 (in FIG. 4). The sequence of motions of the milling rotor housing 8 as described above is thus achieved via the housing support device 12 articulated in the rear region of the milling rotor housing 8 on the one hand and the housing adjusting device 17 on the other hand. Essential elements of the housing adjusting device 17 include a control cam 19 (partially covered by the rotor swivel arm 11 in FIGS. 3 and 4) as well as a swivel thrust lever 20 with a slot guide 21. The control cam 19 is formed by the recess 16 (in the figures partially covered by the rotor swivel arm 11 and in this region partially indicated with dashed lines) in the sidewall 15 of the rotor housing 8. A slide member 22, which is covered by the rotor swivel arm 11 in the figures (indicated with dashed lines in FIGS. 3 and 4), runs along the control cam 19 on the rotor housing 8 side, said slide member being movable together with the rotor swivel arm 11 and resting against the front edge of the recess 16 in the working direction A forming the control cam 19. Upon adjustment of the adjusting drive 10, which in the present case is a hydraulic cylinder, the resulting swivel movement of the rotor swivel arm 11 about S thus also controls the position of the rotor housing 8 relative to the machine frame 2 via the control cam 19.

The swivel thrust lever 20 is articulated to the machine frame 2 and the rotor housing 8 via the joints 20A and 20B, respectively. The joint 20B is formed by a slot 21 extending in the swivel thrust lever 20 in the longitudinal direction of the swivel thrust lever 20, said slot being engaged by a connection pin 23 which is displaceable along the slot 21 and is fixedly arranged on the rotor housing 8. All in all, the arrangement described above thus forms a cam mechanism with the four hinge points 20A, 20B, S and the resting point of the slide member 22 on the control cam 19. The mechanical connection between the slide member 22, i.e. the rotor swivel arm 11, and the control cam 19 has the effect that the milling depth adjusting device 9 and the housing adjusting device 17 are essentially forcibly coupled in a mechanical manner, and thus a height adjustment of the milling rotor 7 about the swivel axis S caused by the adjusting drive 10 is also translated into a movement of the rotor cover 8 relative to the machine frame 2, said movement thus being dependent on the current milling depth.

As a result of the slot guide 21 arranged in the swivel thrust lever 20, the forced translation of the height adjustment of the milling rotor 7 into the lifting movement of the front edge 13 of the milling rotor housing 8 occurs only in certain phases, i.e. when, during a lowering of the milling rotor 7 for height adjustment of the milling rotor 7, the connection pin 23 abuts the abutment end of the slot guide 21 located closer to the hinge point 20A. Only then will the swivel thrust lever 20 transmit a thrust force such that, upon a continued downward swiveling of the rotor swivel arm 11, the slide member 22 resting against the control cam 19 pushes the milling rotor housing 8 in the working direction A towards the front in the bottom region and the swivel thrust lever 20 pushes the milling rotor housing 8 against the working direction A at the hinge point 20B in the top region of the milling rotor housing. This ultimately results in the upward swivel movement of the front edge 13 of the milling rotor housing 8 about the articulation point of the connection chain 12 at the milling rotor housing 8. As a result of the slot, a threshold milling depth is defined upon exceedance of which the upward swivel movement of the front edge of the rotor housing relative to the machine frame occurs as described above.

Figure 5:
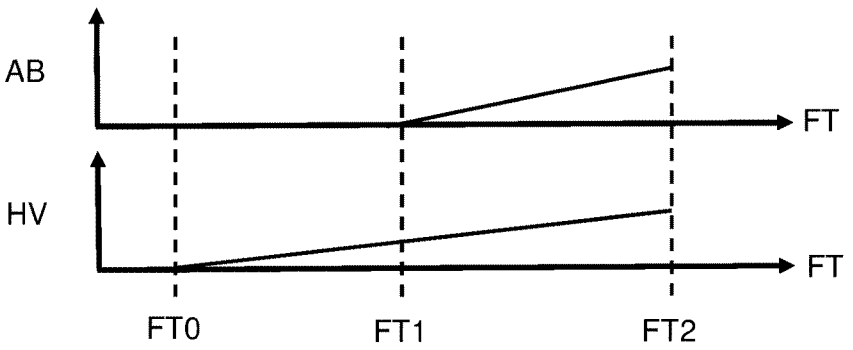
FIG. 5 is a graphical representation of a concurrence of a lifting movement and a displacing movement of the milling rotor housing relative to the machine frame.
Figure 6:
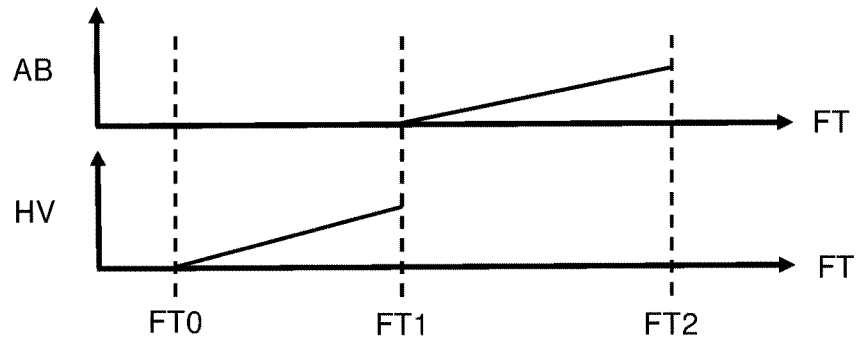
FIG. 6 is a graphical representation of an alternative concurrence of a lifting movement and a displacing movement of the milling rotor housing relative to the machine frame.
Figure 7:
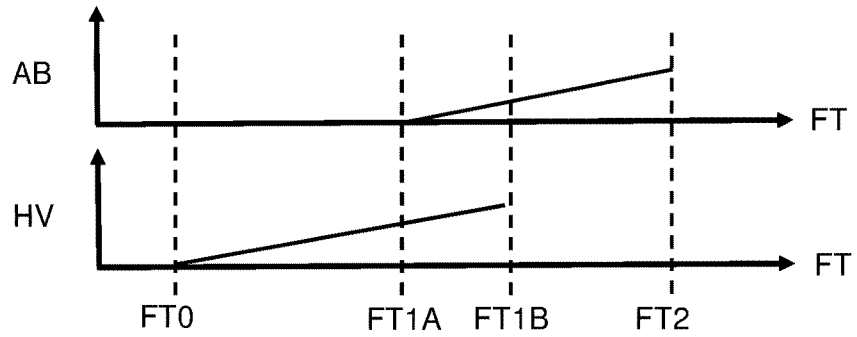
FIG. 7 is a graphical representation of an alternative concurrence of a lifting movement and a displacing movement of the milling rotor housing relative to the machine frame.

FIGS. 5, 6 and 7 now show several exemplary solutions as to how to implement the movements of the milling rotor housing 8 relative to the machine frame 2 in various variants through a corresponding adaptation of the housing adjusting device 17, in particular the control cam 19, the swivel thrust lever 20 and the slot guide 21. The upper graph in each case shows the upward swivel movement AB of the front edge 13 about the rotation point of the milling rotor housing 8, i.e. the angular change of the milling rotor housing 8 with respect to a swivel axis extending transversely to the working direction A and horizontally (for example at the articulation point of the connection chain at the milling rotor housing, as described above), starting from the zero position of the milling rotor housing 8, i.e. the position of the milling rotor housing 8 in which the milling rotor 7 either rests on the non-machined, non-milled underlying ground, in particular together with the milling rotor housing 8 (milling depth FT0) or has such a minimum milling depth FT0 that the milling rotor housing 8 just comes into contact with the underlying ground during the lowering of the rotor swivel arm 11. The lower graph in each case shows the horizontal displacement HV of the milling rotor housing 8 in the working direction A towards the front, also starting from the zero position of the milling rotor housing 8.

In the embodiment example according to FIG. 5, the horizontal displacement of the milling rotor housing 8 in the working direction towards the front starts at a milling depth FT0. The milling rotor housing 8 in this case maintains the height position of the front edge 13 until the milling depth FT1 is reached. Upon exceedance of the threshold milling depth FT1, the forced coupling described above engages and the housing adjusting device 17 effects the lifting of the front edge 13 of the milling rotor housing 8 simultaneously with the horizontal displacement of the milling rotor housing until the maximum milling depth, and thus the maximum horizontal displacement and the maximum upward swivel position of the milling rotor housing 8, is reached at the milling depth FT2.

According to the alternative embodiment example of FIG. 6, the horizontal displacement of the milling rotor housing 8, which occurs from the milling depth FT0 to the milling depth FT1, alternates with the lifting movement of the front edge 13 of the milling rotor housing 8, which occurs from the milling depth FT1 to the maximum milling depth FT2. According to another alternative, which is not shown, for example, the forced coupling, and thus the horizontal displacement and simultaneously also the lifting movement of the front edge 13 of the milling rotor housing 18, occur simultaneously across the entire range from FT0 to FT2.

The embodiment example of FIG. 3 differs from the above variants in that the horizontal displacement HV and the upward swivel movement overlap only partially. A horizontal displacement of the milling rotor housing 8 in the working direction A towards the front is performed in the milling depth range from FT0 to FT1B, and an upward swivel movement AB of the front edge 13 of the milling rotor housing 8 is performed in the milling depth range from FT1A to FT2. A simultaneous movement AB and HV of the milling rotor housing 8 occurs only in the milling depth range from FT1A to FT1B. In this respect, the upward swivel movement AB and the horizontal displacement HV thus each have their own threshold milling depth FT1A and FT1B, respectively.

Instead of the linear curve shapes shown, curved shapes are obviously also possible.

Figure 8:
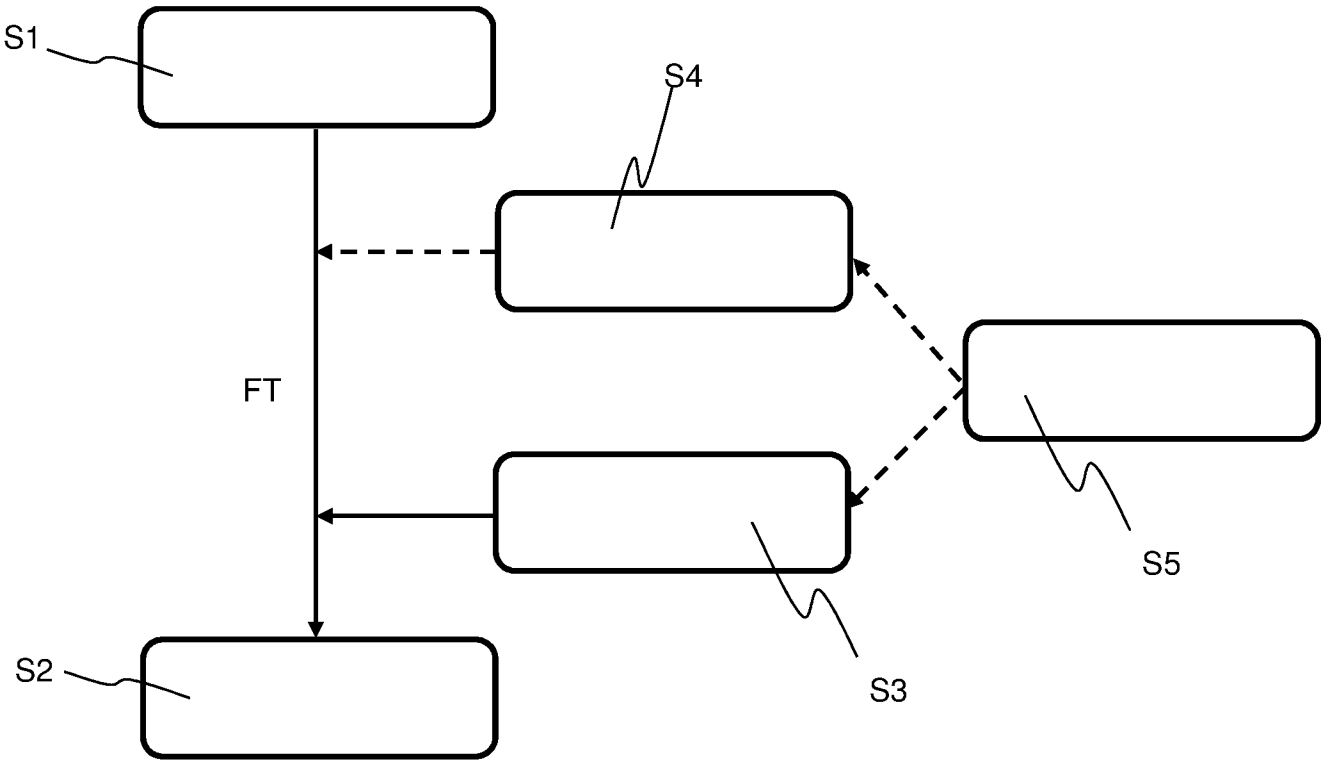
FIG. 8 is a flowchart for operating a ground milling machine.

FIG. 8 finally illustrates the sequence of a method according to the invention which may be carried out in particular with a ground milling machine 1 shown in any of the preceding figures. Step S1 initially involves the lowering of the milling rotor 7 until said rotor and/or the milling rotor housing 8 rests on the underlying ground in its zero position. Depending on the design of the milling rotor housing 8, the milling rotor 7 may already engage the underlying ground at a small milling depth at this point. This corresponds to the milling depth FT0. If the milling depth is now increased further by a continued lowering of the milling rotor 7 via the milling depth adjusting device 9, for example until the maximum milling depth FT2 is reached in step S2, a lifting S3 of the front edge 13 of the milling rotor housing 8 is performed during at least parts of this lowering process, wherein the extent of the lifting movement depends on the current milling depth. The larger the milling depth FT (at least starting from the exceedance of a threshold milling depth), the larger the vertical distance of the front edge 13 from the underlying ground, and vice versa. Step S4 may involve a simultaneous or alternating horizontal displacement of the milling rotor housing 8 relative to the machine frame 2 in the working direction towards the front in connection with steps S1 and S2. In step S5, steps S3 and S4 may preferably be driven together by a single drive device as shown in FIG. 8, i.e. a shared actuator, in particular the adjusting drive 10 of the rotor swivel arm 11, for example using a mechanically forced coupling, or they may each be driven by their own drive device, i.e. their own actuator.

What is claimed is:

1. A ground milling machine, comprising:

a machine frame carried by front and rear traveling devices, comprising a drive engine arranged on the machine frame;

a ground milling device with a milling rotor supported for rotation about a horizontal rotation axis extending transversely to a working direction of the ground milling machine, said milling rotor having a plurality of ground processing tools, and with a milling rotor housing having an interior space which is open in a downward direction towards underlying ground and in which the milling rotor is arranged;

said milling rotor being height-adjustable via a milling depth adjusting device having a drive; and said milling rotor housing being connected to the machine frame via a housing support device, wherein a housing adjusting device is provided which is configured to adjust a position of the milling rotor housing relative to the machine frame depending on a milling depth of the milling rotor such that a front edge of the milling rotor housing is lifted with increasing the milling depth, which enlarges free space underneath the milling rotor housing towards the milling rotor and the underlying ground, and vice versa.

2. The ground milling machine according to claim 1, wherein the housing adjusting device is configured such that, for lifting the front edge, the milling rotor housing rotates about an axis such that a vertical distance of a rear edge of the milling rotor housing from the machine frame remains essentially constant.

3. The ground milling machine according to claim 1, wherein the housing adjusting device has a sensor device for ascertaining the milling depth, a control unit, and an adjusting drive for adjusting the position of the milling rotor housing relative to the machine frame, said control unit controlling the adjusting drive depending on a currently ascertained milling depth.

4. The ground milling machine according to claim 1, wherein the housing adjusting device and the milling depth adjusting device are coupled to one another, and that both the milling depth adjusting device and the housing adjusting device are jointly driven via the drive of the milling depth adjusting device.

5. The ground milling machine according to claim 1, wherein the housing adjusting device has an adjusting mechanism.

6. The ground milling machine according to claim 5, wherein the adjusting mechanism is a cam mechanism.

7. The ground milling machine according to claim 5, wherein the adjusting mechanism comprises at least one of the following features:

a control cam integrated into a sidewall of the milling rotor housing, said control cam being traced by a rotor swivel arm or an element moved together with said rotor swivel arm; and a swivel thrust joint in a swivel lever which connects the machine frame to the milling rotor housing.

8. The ground milling machine according to claim 1, wherein the housing adjusting device is configured to control not only a lifting movement of the milling rotor housing but also a horizontal displacement of the milling rotor housing such that the milling rotor housing is displaced in the working direction towards the front relative to the machine frame and relative to the milling rotor with increasing milling depth, and vice versa.

9. The ground milling machine according to claim 1, wherein the housing adjusting device is configured such that a horizontal displacement and a lifting movement of the milling rotor housing occur at least partially concurrently across a range between a position in which the milling rotor rests on a non-milled underlying ground and a maximally lowered milling rotor.

10. The ground milling machine according to claim 1, wherein the ground milling machine is a soil stabilizer or recycler.

11. A method for operating a ground milling machine, comprising:

obtaining the ground milling machine, the ground milling machine comprising a machine frame carried by front and rear traveling devices, comprising a drive engine arranged on the machine frame;

a ground milling device with a milling rotor supported for rotation about a horizontal rotation axis extending transversely to a working direction of the ground milling machine, said milling rotor having a plurality of ground processing tools, and with a milling rotor housing having an interior space which is open in a downward direction towards underlying ground and in which the milling rotor is arranged;

said milling rotor being height-adjustable via a milling depth adjusting device having a drive; and said milling rotor housing being connected to the machine frame via a housing support device, wherein a housing adjusting device is provided which is configured to adjust a position of the milling rotor housing relative to the machine frame depending on a milling depth of the milling rotor such that a front edge of the milling rotor housing is lifted with increasing the milling depth, which enlarges free space underneath the milling rotor housing towards the milling rotor and the underlying ground, and vice versa;

adjusting milling depth with the milling depth adjusting device; and adjusting the position of the milling rotor housing relative to the machine frame with the housing adjusting device.

12. The method according to claim 11, further comprising starting from an initial position in which the milling rotor rests on a non-milled underlying ground, and lifting the front edge of the milling rotor housing only upon an exceedance of a threshold milling depth.

13. The method according to any one of claim 11, further comprising lifting the front edge of the milling rotor housing such that a rear edge of the milling rotor housing essentially maintains a vertical position relative to the machine frame.

14. The method according to claim 11, further comprising displacing of the milling rotor housing in the working direction towards the front is performed in addition to lifting of the front edge of the milling rotor housing with increasing milling depth.

15. The method according to claim 14, wherein the displacing of the milling rotor housing in the working direction towards the front is performed at least partially concurrently with a lifting of the front edge of the milling rotor housing depending on an exceedance of a threshold milling depth.

16. The method according to claim 11, further comprising lifting of the front edge of the milling rotor housing by tracing a control cam by a rotor swivel arm or an element that is movable together with said rotor swivel arm, and by running along a slot guide in a swivel thrust lever which connects the machine frame to the milling rotor housing.

17. The method according to claim 11, wherein adjusting the position of the milling rotor housing is forcibly coupled to adjusting of the milling depth.

18. The method according to claim 11, wherein adjusting the position of the milling rotor housing and the adjusting of the milling depth are driven by a shared drive.

19. A ground milling machine, comprising:

a machine frame carried by front and rear traveling devices, comprising a drive engine arranged on the machine frame;

a ground milling device with a milling rotor supported for rotation about a horizontal rotation axis extending transversely to a working direction of the ground milling machine, said milling rotor having a plurality of ground processing tools, and with a milling rotor housing having an interior space which is open in a downward direction towards underlying ground and in which the milling rotor is arranged;

said milling rotor being height-adjustable via a milling depth adjusting device having a drive; and said milling rotor housing being connected to the machine frame via a housing support device, wherein a housing adjusting device is provided which is configured to adjust a position of the milling rotor housing relative to the machine frame depending on a milling depth of the milling rotor such that a front edge of the milling rotor housing is lifted with increasing the milling depth and vice versa, and wherein the housing adjusting device has a sensor device for ascertaining the milling depth, a control unit, and an adjusting drive for adjusting the position of the milling rotor housing relative to the machine frame, said control unit controlling the adjusting drive depending on a currently ascertained milling depth.

* * * * *